US009494015B2

(12) United States Patent
Vick, Jr. et al.

(10) Patent No.: US 9,494,015 B2
(45) Date of Patent: Nov. 15, 2016

(54) DUAL CLOSURE SYSTEM FOR WELL SYSTEM

(75) Inventors: James Dan Vick, Jr., Dallas, TX (US); Jimmie Robert Williamson, Jr., Carrollton, TX (US); Bruce Edward Scott, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 643 days.

(21) Appl. No.: 13/703,963

(22) PCT Filed: Dec. 15, 2011

(86) PCT No.: PCT/US2011/065109

§ 371 (c)(1),
(2), (4) Date: Dec. 13, 2012

(87) PCT Pub. No.: WO2013/089730

PCT Pub. Date: Jun. 20, 2013

(65) Prior Publication Data

US 2013/0206389 A1 Aug. 15, 2013

(51) Int. Cl.
*E21B 34/14* (2006.01)
*E21B 43/12* (2006.01)
(Continued)

(52) U.S. Cl.
CPC ..... *E21B 34/14* (2013.01); *E21B 34/101* (2013.01); *E21B 34/102* (2013.01); *E21B 43/128* (2013.01); *E21B 2034/005* (2013.01)

(58) Field of Classification Search
CPC .... E21B 34/066; E21B 34/106; E21B 34/14; E21B 43/128; E21B 34/101; E21B 34/102; E21B 2034/005
See application file for complete search history.

(56) References Cited

U.S. PATENT DOCUMENTS 3,731,742 A 5/1973 Sizer et al.
4,191,248 A 3/1980 Huebsch et al.
(Continued)

FOREIGN PATENT DOCUMENTS

WO 2012166418 12/2012
WO 2013089746 6/2013
WO 2013089753 6/2013

OTHER PUBLICATIONS

International Patent Application No. PCT/US2011/065109, "International Search Report and Written Opinion", mailed Aug. 3, 2012, 9 pages.
(Continued)

*Primary Examiner* — Robert E Fuller
*Assistant Examiner* — Christopher Sebesta
(74) *Attorney, Agent, or Firm* — Kilpatrick Townsend & Stockton LLP

(57) ABSTRACT

Certain aspects and embodiments of the present invention are directed to a dual closure system disposed within a wellbore and capable of preventing the production of fluids from a fluid-producing formation to the surface. The dual closure system can include a passive closure mechanism and a subsurface safety valve coupled to an electric submersible pump positioned within a passageway defined by the tubing string. The passive closure mechanism and the subsurface safety valve can prevent production of fluid in the absence of the subsurface safety valve. The subsurface safety valve can be positioned within a passageway defined by a tubing string such that the subsurface safety valve can apply force to the passive closure mechanism. The force applied to the passive closure mechanism can maintain the passive closure mechanism in an open position, allowing movement of fluid to the surface in the presence of the active closure mechanism.

20 Claims, 7 Drawing Sheets

(51) Int. Cl.
*E21B 34/10* (2006.01)
*E21B 34/00* (2006.01)

(56) References Cited

U.S. PATENT DOCUMENTS

| | | | | |
|---|---|---|---|---|
| 4,425,965 | A | 1/1984 | Bayh et al. | |
| 4,440,221 | A | 4/1984 | Taylor et al. | |
| 4,621,689 | A * | 11/1986 | Brookbank, III | 166/106 |
| 4,768,594 | A | 9/1988 | Akkerman | |
| 4,852,648 | A | 8/1989 | Akkerman et al. | |
| 4,880,060 | A | 11/1989 | Schwendemann et al. | |
| 5,070,944 | A * | 12/1991 | Hopper | 166/66.7 |
| 5,996,687 | A * | 12/1999 | Pringle et al. | 166/66.6 |
| 6,089,322 | A * | 7/2000 | Kelley et al. | 166/370 |
| 6,227,299 | B1 * | 5/2001 | Dennistoun | 166/332.8 |
| 6,283,217 | B1 | 9/2001 | Deaton | |
| 6,398,583 | B1 | 6/2002 | Zehren | |
| 6,957,703 | B2 | 10/2005 | Trott et al. | |
| 7,624,795 | B1 | 12/2009 | Bangash et al. | |
| 7,798,229 | B2 | 9/2010 | Vick, Jr. et al. | |
| 8,056,621 | B2 | 11/2011 | Ring et al. | |
| 9,140,101 | B2 | 9/2015 | Scott et al. | |
| 2002/0053426 | A1 * | 5/2002 | Kelley et al. | 166/67 |
| 2003/0234104 | A1 * | 12/2003 | Johnston et al. | 166/298 |
| 2004/0188096 | A1 | 9/2004 | Traylor | |
| 2006/0118307 | A1 | 6/2006 | Williamson et al. | |
| 2007/0187107 | A1 * | 8/2007 | Pringle | 166/319 |
| 2007/0205000 | A1 | 9/2007 | Hosie et al. | |
| 2007/0295504 | A1 | 12/2007 | Patel | |
| 2008/0230231 | A1 * | 9/2008 | Bolding et al. | 166/375 |
| 2010/0108320 | A1 * | 5/2010 | Larnach | 166/310 |
| 2011/0155381 | A1 | 6/2011 | Reaux | |
| 2011/0155392 | A1 | 6/2011 | Frazier | |
| 2011/0247828 | A1 | 10/2011 | Patel et al. | |
| 2012/0199367 | A1 * | 8/2012 | Bouldin et al. | 166/374 |
| 2013/0175025 | A1 | 7/2013 | Vick, Jr. et al. | |
| 2013/0175042 | A1 | 7/2013 | Scott et al. | |

OTHER PUBLICATIONS

International Patent Application No. PCT/US2011/065204, "International Search Report and Written Opinion", mailed Sep. 12, 2012, 10 pages.

International Patent Application No. PCT/US2011/065253, "International Search Report and Written Opinion", mailed Sep. 12, 2012, 9 pages.

GCC Patent Application No. 2012/23035, Office Action mailed Jan. 21, 2016, 4 pages.

* cited by examiner

DUAL CLOSURE SYSTEM FOR WELL SYSTEM

CROSS-REFERENCE TO RELATED APPLICATIONS

This application is a U.S. national phase patent application under 35 U.S.C. 371 of International Patent Application No. PCT/US2011/065109 entitled "Dual Closure System for Well System," filed Dec. 15, 2011, and is related to International Patent Application No. PCT/US2011/065204 entitled "Integrated Opening Subsystem for Well Closure System," filed Dec. 15, 2011; International Patent Application No. PCT/US2011/065253 entitled "Subsurface Safety Valve Deployable Via Electric Submersible Pump," filed Dec. 15, 2011; U.S. patent application Ser. No. 13/703,933 entitled "Integrated Opening Subsystem for Well Closure System", filed Dec. 13, 2012; and U.S. patent application Ser. No. 13/703,953 entitled "Subsurface Safety Valve Deployable Via Electric Submersible Pump," filed Dec. 13, 2012; the contents of each of which are incorporated herein by reference in their entirety.

TECHNICAL FIELD OF THE INVENTION

The present invention relates generally to devices for controlling fluid flow in a wellbore in a subterranean formation and, more particularly (although not necessarily exclusively), to devices that are capable of restricting fluid flow from a well.

BACKGROUND

Pumping systems for a well, such as an oil or gas well for extracting fluids that can include petroleum oil hydrocarbons from a subterranean formation, can require periodic maintenance or removal from the well. Pressure from a hydrocarbon-bearing subterranean formation can cause fluids from the formation to move toward the surface in the absence of a pumping system or other artificial lift system. The flow of fluids from the formation toward the surface in the absence of a pumping system can hinder the replacement of a submersible pump or other downhole equipment in a well system. Maintaining or replacing a pumping system can require restricting or preventing the flow of fluids from a hydrocarbon-bearing subterranean formation in which the well is located. Performing maintenance or remedial treatments on an oil or gas well can include, for example, a workover rig replacing the production tubing string after stopping well production.

The oil or gas wells requiring maintenance or repair can exceed the number of rigs available in a fleet. The queue time (or wait time) for rig availability can be difficult to manage. Many wells can go years without production, waiting for a rig to perform maintenance or repair.

It is desirable to include a mechanism in a well that can prevent fluids from flowing from the formation to the surface to facilitate maintenance or repair of a well in the absence of a pumping system in the well.

SUMMARY

In some embodiments, a dual closure system is provided that can be disposed in a wellbore through a fluid-producing formation. The dual closure system includes a subsurface safety valve and a passive closure mechanism. The subsurface safety valve can be coupled to an electric submersible pump. The subsurface safety valve can include an active closure mechanism that can be positioned in a passageway defined by a tubing string. The passive closure mechanism can be coupled to the tubing string. In the absence of the subsurface safety valve in the passageway, the passive closure mechanism can be in a closed position that prevents a flow of fluid to a portion of the passageway that is closer to a surface of the wellbore than the passive closure mechanism. The subsurface safety valve can be positioned in the passageway of the tubing string. Positioning the subsurface safety valve in the passageway causes the passive closure mechanism to be in an open position allowing the flow of fluid to a second portion of the passageway that is closer to the surface of the wellbore than the passive closure mechanism.

These illustrative aspects and features are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
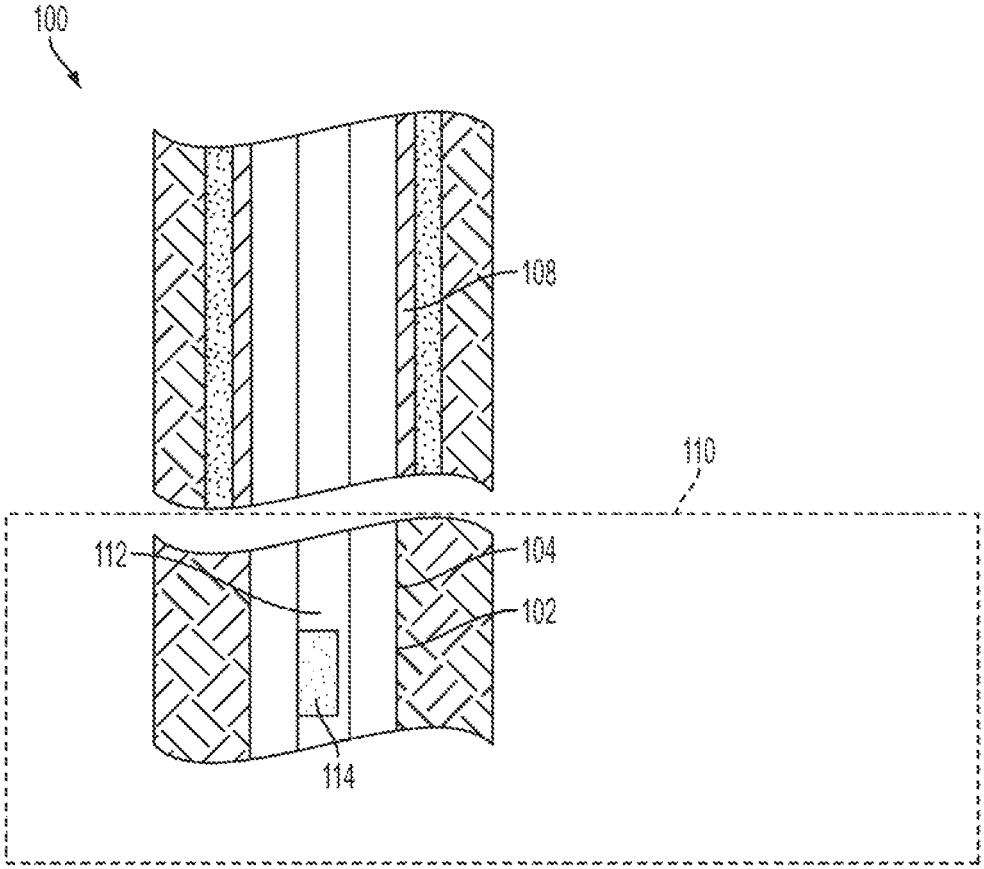
FIG. 1 is a schematic illustration of a well system having a dual closure system according to one embodiment of the present invention.

Certain aspects and embodiments of the present invention are directed to a dual closure system capable of being disposed in a wellbore and of restricting or preventing the flow of fluids from the fluid-producing formation to the surface. A subsurface safety valve having an active closure mechanism, such as (but not limited to) an electrically powered flapper valve, can be positioned in the wellbore so as to apply force opening a passive closure mechanism, such as (but not limited to) a mechanically operated flapper valve, coupled to a tubing string in the wellbore. The passive closure mechanism can prevent the flow of production fluids in the absence of the subsurface safety valve. The use of both the subsurface safety valve and the passive closure device can provide a system for controlling or preventing fluid flow whether a pumping system is present in the well or absent from the well.

In some embodiments, a dual closure system includes a subsurface safety valve configured to be coupled to an electric submersible pump, and a passive closure mechanism coupled to a tubing string. The subsurface safety valve can be positioned in a passageway defined by a tubing string. The subsurface safety valve can include an active closure mechanism.

A closure mechanism can be a mechanism for restricting or preventing the flow of fluid from the fluid-producing formation fluid to the surface, such as a valve. Examples of closure mechanisms can include (but are not limited to) a flapper valve, a ball valve, or a poppet valve. A flapper valve can include a spring-loaded plate allowing fluids to be pumped in the downhole direction from the surface toward the fluid-producing formation. The flapper valve can close when the flow of fluid is directed toward the surface, stopping the flow of fluid. A ball valve can include a spherical disc having a port through the middle such that fluids can flow through the ball valve when the port is aligned with both ends of the ball valve. The ball valve can be closed to block the flow of fluids by orienting spherical disc such that the port is perpendicular to the ends of the ball valve. A poppet valve can include a hole and a tapered plug portion, such as a disk shape on the end of a shaft. The shaft guides the plug portion by sliding through a valve guide. A pressure differential can seal the poppet valve.

The active closure mechanism can include a valve configured to be set in an open position by a force applied to the valve by a mechanism integrated with the subsurface safety valve. The open position can allow a flow of fluid to a portion of the passageway that is closer to the surface of the wellbore than the passive closure mechanism. Conversely, a closed position can prevent a flow of fluid to a portion of the passageway that is closer to a surface of the wellbore than the passive closure mechanism in the absence of the subsurface safety valve in the passageway. The passive closure mechanism can include a valve configured to be set in an open position by a force applied to the valve by a mechanism separate from the passive closure mechanism.

An electric submersible pump can be coupled to the subsurface safety valve. The electric submersible pump can be powered by a power cable coupled to the electric submersible pump. The electric submersible pump can be retrieved from a well by a retrieval unit using the power cable coupled to the electric submersible pump. Using a retrieval unit to retrieve the electric submersible pump can obviate the need to use a workover rig to remove a production tubing section to which the electric submersible pump is coupled. A retrieval unit can be a mechanism including a cable for lowering tools into a wellbore. An example of a retrieval unit is a wireline unit.

A subsurface safety valve coupled to an electric submersible pump can be electrically operated to control the active closure mechanism. In some embodiments, the subsurface safety valve and the electric submersible pump can receive power from a common power cable. In other embodiments, the electric submersible pump can draw power from a first power cable and the subsurface safety valve can draw power from a second power cable.

The passive closure mechanism is configured to be in a closed position in the absence of the subsurface safety valve in the passageway. The subsurface safety valve can be positioned in the passageway defined by the tubing string. Positioning the subsurface safety valve in the passageway defined by the tubing string can cause the passive closure mechanism to be in an open position.

In additional or alternative embodiments, the dual closure system can include a sleeve, which may be a spring-loaded sleeve. The subsurface safety valve can be positioned within a passageway defined by the tubing string so as to apply a first force to the spring-loaded sleeve. The first force can cause the spring-loaded sleeve to apply a second force to the passive closure mechanism. The second force applied to the passive closure mechanism can open the passive closure mechanism and/or maintain the passive closure mechanism in the open position. The spring-loaded sleeve can include a spring having tension sufficient to retract the spring-loaded sleeve upon the removal of the subsurface safety valve from the wellbore. Retracting the spring-loaded sleeve can remove the force applied to the passive closure mechanism, causing the passive closure mechanism to be in a closed position.

In some embodiments, the passive closure mechanism can be retrieved via a cable inserted within a passageway defined by the tubing string.

In additional or alternative embodiments, the dual closure system can include an equalizing subsystem that can equalize pressure across the passive closure mechanism. Equalizing the pressure across the passive closure mechanism can decrease the force applied to set the passive closure mechanism to an open position. The equalizing subsystem can include, but is not limited to, an unloading pump. An unloading pump can equalize pressure across the passive closure mechanism by pumping fluid from a portion of the passageway that is further from the surface of the wellbore to a second portion of the passageway that is closer to the surface of the wellbore.

In additional or alternative embodiments, the dual closure system can include an equalizing subsystem that can equalize pressure across the subsurface safety valve. The equalizing subsystem can include, but is not limited to, an unloading pump. The unloading pump can equalize pressure across the active closure mechanism of the subsurface safety valve by pumping fluid from a portion of the passageway that is further from the surface of the wellbore to a second portion of the passageway that is closer to the surface of the wellbore.

In additional or alternative embodiments, the dual closure system can include a two-stage closing process to prevent accidental closure of the active closure mechanism during the operation of an electric submersible pump coupled to the subsurface safety valve. The first stage can include transmitting a signal to the subsurface safety valve to close the subsurface safety valve partially. The second stage can include completely closing the subsurface safety valve when the electric submersible pump ceases operation.

In additional or alternative embodiments, the electric submersible pump can include a trigger mechanism to terminate operation of the electric submersible pump upon closure of the subsurface safety valve. Terminating operation of the electric submersible pump can prevent damage to the electric submersible pump from operating in the absence of fluid within a passageway defined by the tubing string. In some embodiments, the trigger mechanism can include, for example, a float switch configured to be in an "on" position by fluid flowing through a passageway defined by the tubing string, allowing operation of the electric submersible pump. Closing the subsurface safety valve can cause fluid to cease flowing through the passageway defined by the tubing string, setting the float switch to an "off" position and terminating operation of the electric submersible pump.

In additional or alternative embodiments, the trigger mechanism can be operated via a signal communicated to the subsurface safety valve. Closing the subsurface safety valve can include communicating a signal directing the activation of the trigger mechanism from a control system to the subsurface safety valve via a communication subsystem.

In additional or alternative embodiments, the dual closure system can include a sensor preventing the activated trigger mechanism from closing the subsurface safety valve during operation of the electric submersible pump. For example, the sensor can engage a locking mechanism, such as an electromechanical braking mechanism, opposing the operation of the trigger mechanism. The locking mechanism can be disengaged by the sensor failing to detect the operation of the electric submersible pump. In some embodiments, the sensor can detect the operation of the electric submersible pump by detecting current or voltage associated with the operation of one or more components of the electric submersible pump. In other embodiments, the sensor can detect the operation of the electric submersible pump by detecting the sound or flow of fluids resulting from the operation of the electric submersible pump. In other embodiments, the sensor can be activated by a proximity switch.

In additional or alternative embodiments, the electric subsurface safety valve can include an override subsystem. The override subsystem can maintain the electric subsurface safety valve in an open position during a power failure. In some embodiments, the override can include a motor powered by the battery power subsystem. The motor can apply force opening the electric subsurface safety valve in response to the communication subsystem receiving a signal directing the override to open the electric subsurface safety valve. In other embodiments, the override subsystem can include a motor operated using a current from the electric submersible pump. For example, a current operating in a positive direction can operate the electric submersible pump and the current operating in a negative direction can operate the electric subsurface safety valve.

In additional or alternative embodiments, the dual closure system can include one or more sensors to monitor performance of the electric submersible pump and/or the subsurface safety valve.

In additional or alternative embodiments, the dual closure system can include a first motor for operating the electric submersible pump and a second motor for opening the subsurface safety valve. In other embodiments, the subsurface safety valve can be opened by the same motor operating an electric submersible pump coupled to the subsurface safety valve. The subsurface safety valve can include gearing and/or clutch mechanisms powered by the motor operating the electric submersible pump.

In additional or alternative embodiments, a control line can be deployed into the passageway defined by the tubing string to control the subsurface safety valve.

These illustrative examples are given to introduce the reader to the general subject matter discussed here and are not intended to limit the scope of the disclosed concepts. The following sections describe various additional embodiments and examples with reference to the drawings in which like numerals indicate like elements, and directional descriptions are used to describe the illustrative embodiments but, like the illustrative embodiments, should not be used to limit the present invention.

FIG. 1 schematically depicts a well system 100 with a dual closure system 114 according to certain embodiments of the present invention. The well system 100 includes a wellbore 102 extending through various earth strata. The wellbore 102 has a substantially vertical section 104. The substantially vertical section 104 may include a casing string 108 cemented at an upper portion of the substantially vertical section 104. The substantially vertical section 104 extends through a hydrocarbon-bearing subterranean formation 110.

A tubing string 112 extends from the surface within wellbore 102. The tubing string 112 can define a passageway providing a conduit for production of formation fluids to the surface.

The dual closure system 114 is positioned within a passageway defined by the tubing string 112. The dual closure system 114 is depicted as functional block in FIG. 1. Pressure from the subterranean formation 110 can cause fluids to flow from the subterranean formation 110 to the surface. The dual closure system 114 can include equipment capable of restricting or preventing the production of formation fluids.

Although FIG. 1 depicts the dual closure system 114 positioned in the substantially vertical section 104, a dual closure system 114 can be located, additionally or alternatively, in a deviated section, such as a substantially horizontal section. In some embodiments, dual closure systems 114 can be disposed in wellbores having both a substantially vertical section and a substantially horizontal section. Dual closure systems 114 can be disposed in open hole environments, such as is depicted in FIG. 1, or in cased wells.

Figure 2:
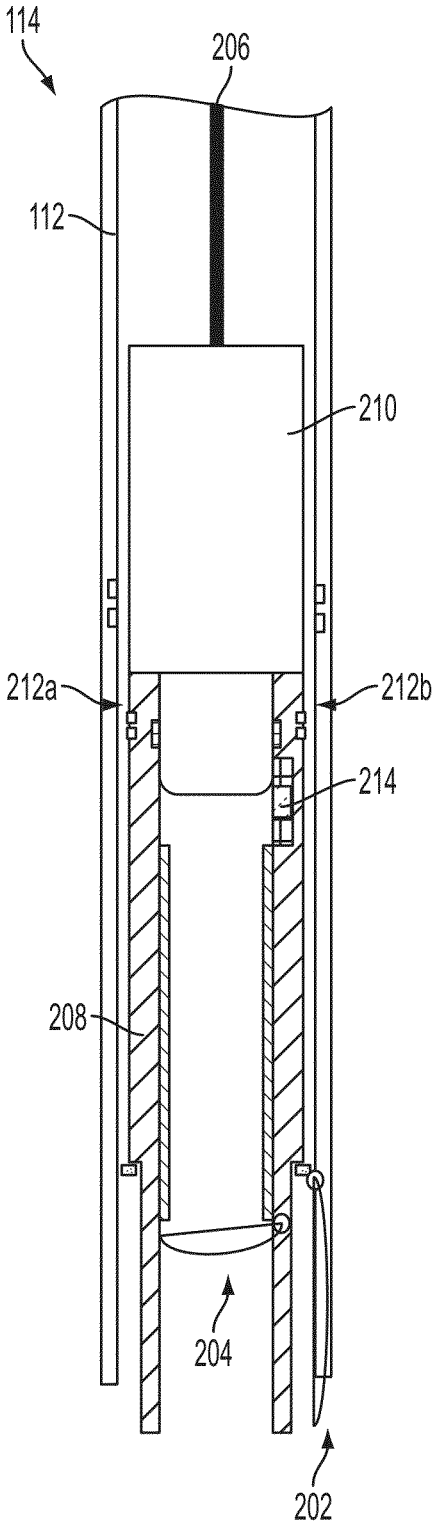
FIG. 2 is a cross-sectional side view of a dual closure system having a passive closure mechanism and subsurface safety valve coupled to an electric submersible pump according to one embodiment of the present invention.

FIG. 2 depicts a cross-sectional side view of dual closure system 114 having a passive closure mechanism 202 and a subsurface safety valve 208 coupled to an electric submersible pump 210 according to one embodiment. The subsurface safety valve 208 can include an electric submersible pump 210 and subsurface safety valve 208. The tubing string 112 defines an interior passageway, which may be an annular space.

The passive closure mechanism 202 can be positioned within a passageway defined by the tubing string 112. The passive closure mechanism 202 can control a flow of fluids from a hydrocarbon-bearing subterranean formation 110 in the absence of a pumping system from the tubing string 112. Controlling the flow of fluids can include restricting or preventing the flow of fluids.

The subsurface safety valve 208 can be positioned within a passageway defined by the tubing string 112 such that the subsurface safety valve 208 can apply force to the passive closure mechanism 202. In one embodiment, the subsurface safety valve 208 can be positioned in a passageway defined by the tubing string 112, thereby causing the subsurface safety valve 208 to contact the passive closure mechanism 202. The subsurface safety valve 208 positioned in the passageway can apply force to the passive closure mechanism 202. The force applied to the passive closure mechanism 202 can cause the passive closure mechanism 202 to move to an open position.

The subsurface safety valve 208 can be coupled to the tubing string 112 via coupling points 212*a*, 212*b*. Coupling the subsurface safety valve 208 to the tubing string 112 can cause force to be applied to the passive closure mechanism 202, maintaining the passive closure mechanism 202 in an open position.

The subsurface safety valve 208 can include a locking mechanism 214 to maintain the subsurface safety valve 208 in the open position. In some embodiments, the locking mechanism 214 can include an electro-mechanical brake, such as a crown tooth or friction plate. In other embodiments, the locking mechanism 214 can include a solenoid maintaining the subsurface safety valve 208 in an open position.

Figure 3:
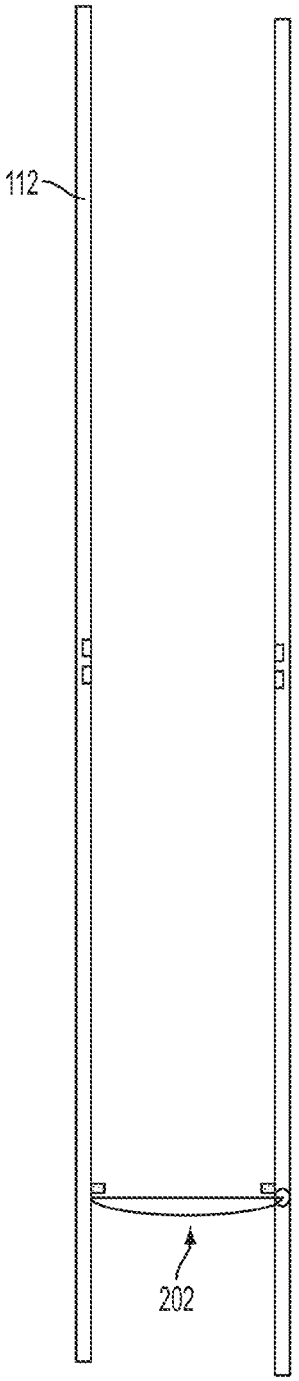
FIG. 3 is a cross-sectional side view of a passive closure mechanism according to one embodiment of the present invention.

FIG. 3 depicts a cross-sectional side view of a passive closure mechanism according to one embodiment. The passive closure mechanism 202 can include any mechanism for permitting fluid to flow or pressure to be communicated in one direction and preventing fluid from flowing or pressure from being communicated in an opposite direction. Although the passive closure mechanism 202 is depicted as including a flapper valve, the passive closure mechanism 202 can include other mechanisms for regulating the flow of fluids through the tubing string 112. Examples of such other mechanisms can include (but are not limited to) a ball valve or a poppet valve. The passive closure mechanism can be in a closed position in the absence of a pumping system within a passageway defined by the tubing string 112.

In some embodiments, the passive closure mechanism 202 can be inserted within a passageway defined by the tubing string 112 with the passive closure mechanism 202 being in an open position. A shear pin arrangement can maintain the passive closure mechanism in the open position until the shear pin is broken. An example of a shear pin arrangement is a plain metal rod inserted through a hub and axle, where the diameter of the rod is selected so as to allow the shearing action when the desired force or shock breaking the shear pin is applied to the shear pin arrangement. The deployment of an electric submersible pump in the well can break the shear pin, thereby allowing the passive closure mechanism to be in either an open or a closed position. The shear pin can also be broken by running in a secondary tool, such as a lock mandrel, and manipulating a spring-loaded sleeve of the passive closure mechanism such that the shear pin is broken.

Figure 4:
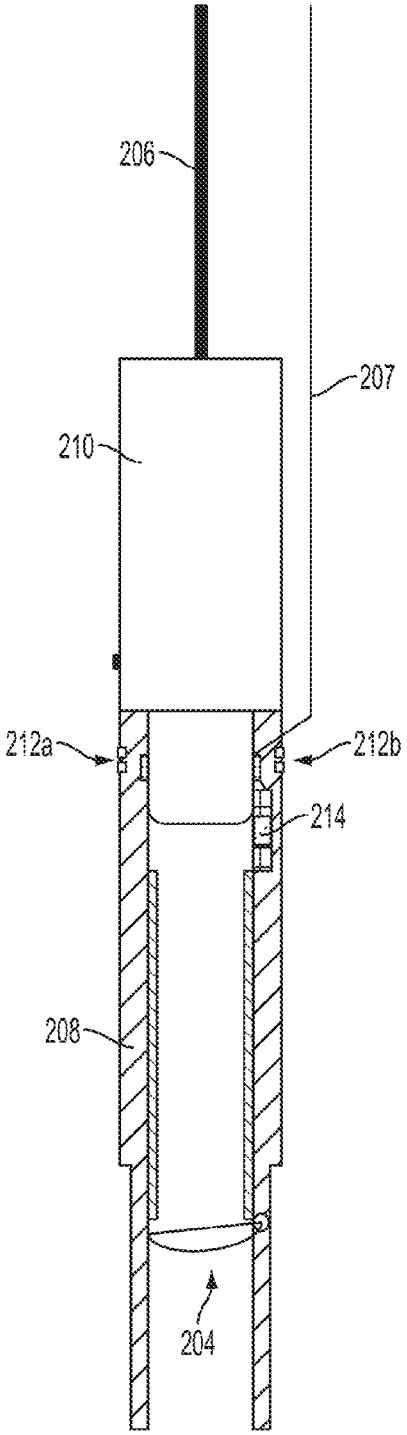
FIG. 4 is a cross-sectional side view of a subsurface safety valve having an active closure mechanism and coupled to an electric submersible pump according to one embodiment of the present invention.

FIG. 4 depicts a cross-sectional side view of a subsurface safety valve 208 having an active closure mechanism 204 and coupled to an electric submersible pump 210 according to one embodiment. The subsurface safety valve 208 coupled to the electric submersible pump 210 can be inserted into a passageway defined by the tubing string 112 via a cable 206 attached to the electric submersible pump 210. The electric submersible pump 210 can be retrieved from the passageway using the cable 206.

The electric submersible pump 210 can be an electrically powered downhole pumping system or other artificial lift system for extracting formation fluids from the subterranean formation 110. The electric submersible pump 210 can include several staged centrifugal pump sections customized to the production characteristics and wellbore characteristics of a well. In some embodiments, the electric submersible pump 210 can include two or more independent electric submersible pumps coupled together for redundancy.

The active closure mechanism 204 included in the subsurface safety valve 208 can be any mechanism for permitting fluid to flow or pressure to be communicated in one direction and preventing fluid from flowing or pressure from being communicated in an opposite direction. Although the active closure mechanism 204 is depicted as including a flapper valve, the active closure mechanism 204 can include other mechanisms for regulating the flow of fluids through the tubing string 112. Examples of such mechanisms can include (but are not limited to) a ball valve or a poppet valve.

The subsurface safety valve 208 can be electrically operated. In some embodiments, the electric submersible pump 210 can receive power via the cable 206 and the subsurface safety valve 208 can receive power via a second power cable 207. In other embodiments, the subsurface safety valve 208 and an electric submersible pump 210 to which the subsurface safety valve 208 is coupled can both receive power from the cable 206. In other embodiments, a subsurface safety valve 208 coupled to an electric submersible pump 210 can receive power provided by the electric submersible pump 210 via an electrical connection at a junction between the subsurface safety valve 208 and the electric submersible pump 210.

Figure 5:
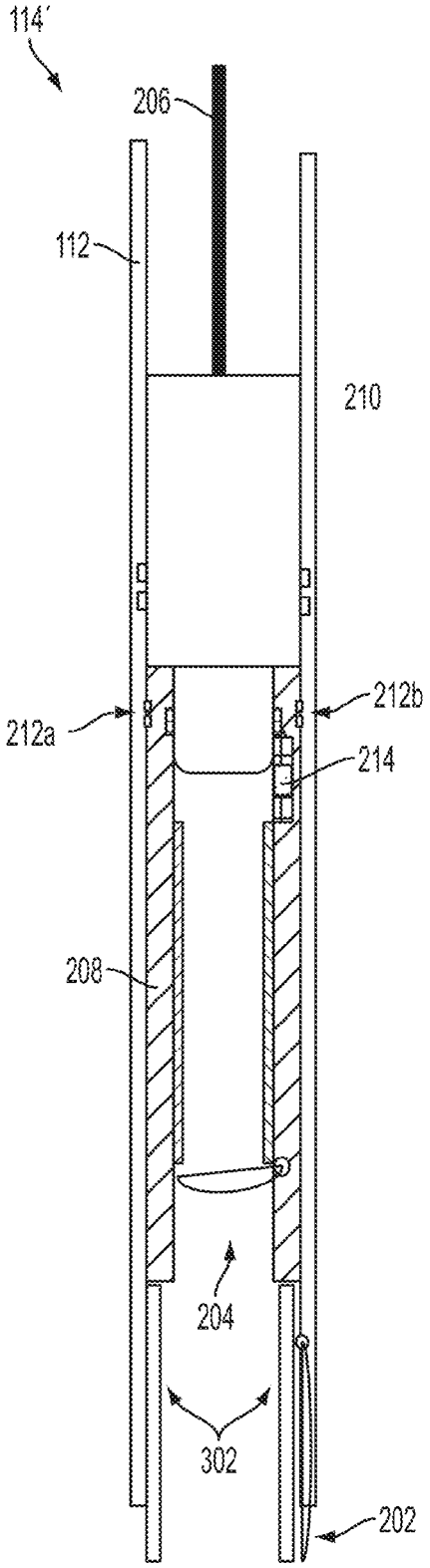
FIG. 5 is a cross-sectional side view of a dual closure system having a sleeve for applying force to the passive closure mechanism according to one embodiment of the present invention.

FIG. 5 depicts a cross-sectional side view of a dual closure system 114' having a sleeve 302 for applying force to the passive closure mechanism 202 according to one embodiment.

The sleeve 302 can include a rigid tubing section and a spring. The sleeve 302 can be positioned within a passageway defined by the tubing string 112 between the passive closure mechanism 202 and the subsurface safety valve 208.

One embodiment can include inserting the subsurface safety valve 208 into a passageway defined by the tubing string 112 so as to contact the sleeve 302. In some embodiments, the spring of the sleeve 302 can be a compression spring. Inserting the subsurface safety valve 208 can apply force to the sleeve 302 and compress the spring of the sleeve 302. The force applied to the sleeve 302 can cause the sleeve 302 to apply force to the passive closure mechanism 202. The force applied to the passive closure mechanism 202 can cause the passive closure mechanism 202 to be in an open position. A locking mechanism can anchor the subsurface safety valve 208 to the tubing string 112 such that the passive closure mechanism 202 is maintained in an open position by the force applied by the subsurface safety valve 208.

The sleeve 302 can be customized to minimize damage to the passive closure mechanism 202 from applying force to the passive closure mechanism 202. Customizing the sleeve 302 can include orienting the sleeve 302 within a passageway defined by the tubing string 112.

Retracting the sleeve 302 can remove the force applied to the passive closure mechanism 202, causing the passive closure mechanism 202 to be in a closed position. The spring of the sleeve 302 can have a tension sufficient to retract the spring-loaded sleeve upon the removal of the subsurface safety valve 208 from the tubing string 112. Removing the subsurface safety valve 208 can allow the spring of the sleeve 302 to extend. Extending the spring of the sleeve 302 can retract the sleeve 302 and thereby remove the force applied to the passive closure mechanism 202. Removing the force applied to the passive closure mechanism 202 can set the passive closure mechanism 202 a closed position.

In other embodiments, the spring of the sleeve 302 can be an extension spring coupled to the sleeve 302. Inserting the subsurface safety valve 208 can apply force to the sleeve 302 and extend the extension spring. Removing the subsurface safety valve 208 can allow the spring of the sleeve 302 to contract, removing the force applied to the passive closure mechanism 202 and setting the passive closure mechanism 202 a closed position.

Figure 6:
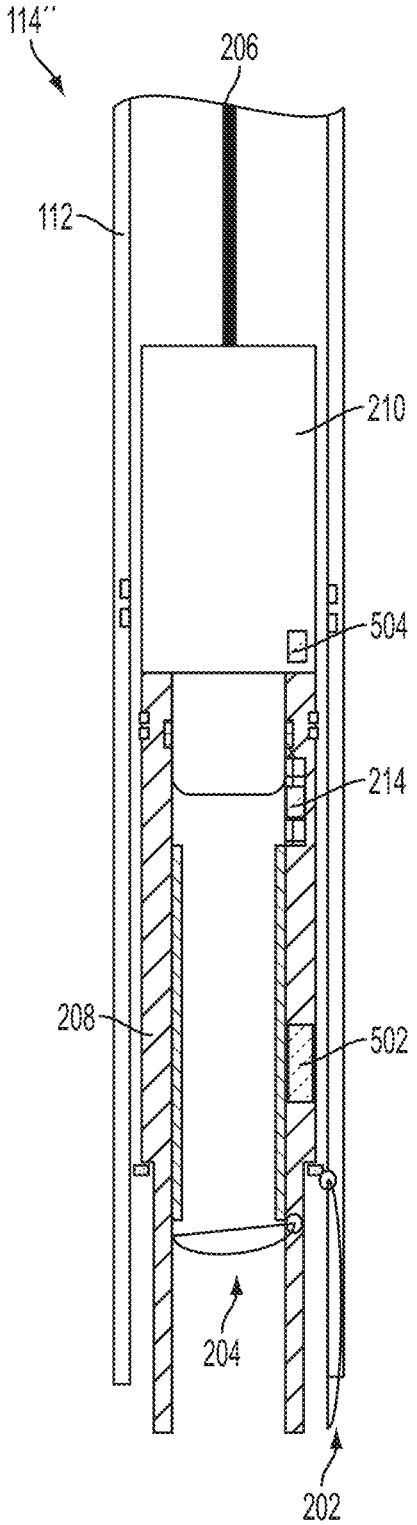
FIG. 6 is a cross-sectional side view of a dual closure system having additional features for controlling the subsurface safety valve according to one embodiment of the present invention.

FIG. 6 depicts a cross-sectional side view of a dual closure system 114" having additional features for controlling the subsurface safety valve 208 according to one embodiment. The dual closure system 114" can include an override 502 and a trigger mechanism 504.

In some embodiments, the subsurface safety valve 208 can include a fail-safe mechanism causing the subsurface safety valve 208 to close in the event of a power failure. The override 502 can open a subsurface safety valve 208 that has been closed by the fail-safe mechanism. In some embodiments, the override 502 can include a battery-powered motor and communication subsystem disposed in the subsurface safety valve 208. The motor can apply force opening the subsurface safety valve 208 in response to the communication subsystem receiving a signal directing the override to open the subsurface safety valve 208. In other embodiments, the override 502 can communicate a control signal to the electric submersible pump 210, causing the electric submersible pump 210 to reverse the direction of the flow such that pressure provided by the electric submersible pump 210 forces open the subsurface safety valve 208. In other embodiments, the override subsystem can include a motor operated using a current from the electric submersible pump 210. For example, a current operating in a positive direction can operate the electric submersible pump 210 and the current operating in a negative direction can operate the subsurface safety valve 208, causing the subsurface safety valve 208 to open.

The trigger mechanism 504 can terminate operation of the electric submersible pump 210 upon closure of the subsurface safety valve 208. Terminating operation of the electric submersible pump 210 can prevent damage to the electric submersible pump 210 caused by the electric submersible pump 210 operating in the absence of fluid within the passageway defined by the tubing string 112.

Figure 7:
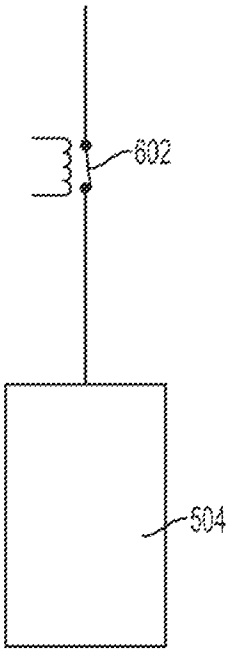
FIG. 7 is a block diagram of a trigger mechanism operated by a relay control switch according to one embodiment of the present invention.

FIG. 7 depicts a block diagram of a trigger mechanism 504 operated by a relay control switch 602 according to one embodiment. In some embodiments, the relay control switch 602 can be open during operation of the electric submersible pump 210, preventing the trigger mechanism 504 from being activated in the absence of power being provided to the trigger mechanism 504. The closure of the subsurface safety valve 208 can generate a signal causing the relay control switch 602 to close. Closing the relay control switch 602 can provide power to the trigger mechanism 504. Providing power to the trigger mechanism 504 can cause the trigger mechanism 504 to activate, terminating the operation of the electric submersible pump 210. In other embodiments, the relay control switch 602 can be closed during operation of the electric submersible pump 210, causing power to be provided to the trigger mechanism 504. The power provided to the trigger mechanism 504 can prevent the trigger mechanism 504 from being activated. The closure of the subsurface safety valve 208 can generate a signal causing the relay control switch 602 to open, terminating the provision of power to the trigger mechanism 504. Terminating the provision of power to the trigger mechanism 504 can cause the trigger mechanism 504 to activate, causing the operation of the electric submersible pump 210 to terminate.

Figure 8:
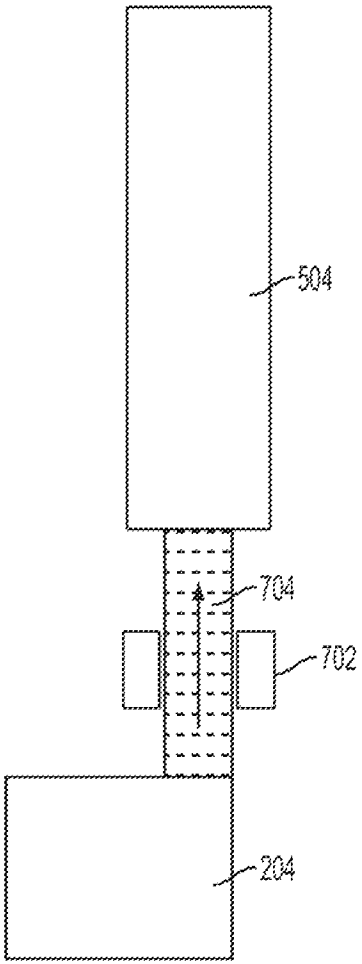
FIG. 8 is a block diagram of a trigger mechanism operated by an electromechanical braking mechanism according to one embodiment of the present invention.

The trigger mechanism 504 can also cause the subsurface safety valve 208 to close upon terminating operation of the electric submersible pump 210. FIG. 8 depicts a block diagram of a trigger mechanism 504 operated by an electromechanical braking mechanism 702 according to one embodiment. The electromechanical braking mechanism 702 can prevent a closure device 704 coupled to the active closure mechanism 204 from closing the active closure mechanism 204. The closure device 704 can include, for example, a piston coupled to the active closure mechanism 204. Power can be provided to the electromechanical braking mechanism 702 during the operation of the electric submersible pump 210. Terminating the operation of the electric submersible pump 210 can terminate the provision of power to the electromechanical braking mechanism 702. Terminating the provision of power to the electromechanical braking mechanism 702 can cause the trigger mechanism 504 to retract the closure device 704, causing the active closure mechanism 204 to close.

In some embodiments, the mechanisms for operating the trigger mechanism 504 depicted in FIGS. 6-7 can be operated in combination such that closing the subsurface safety valve 208 terminates operation of the electric submersible pump 210 and the terminating operation of the electric submersible pump 210 closes the subsurface safety valve 208.

In other embodiments, the trigger mechanism 504 can include, for example, a float switch. The float switch can be in an "on" position to allow operation of the electric submersible pump 210 by fluid flowing through the tubing string 112. Closing the subsurface safety valve 208 can cause fluid to cease flowing through the passageway defined by the tubing string 112, setting the float switch to an "off" position to terminate operation of the electric submersible pump 210.

A sensor can prevent the trigger mechanism 504 from closing the subsurface safety valve 208. The sensor can detect the operation of the electric submersible pump 210. In some embodiments, detecting the operation of the electric submersible pump 210 can include detecting current or voltage associated with the operation of one or more components of the electric submersible pump 210. In other embodiments, detecting the operation of the electric submersible pump 210 can include detecting the sound or flow of fluids resulting from the operation of the electric submersible pump 210. In other embodiments, the sensor can be activated by a proximity switch. Activating the sensor can prevent the subsurface safety valve 208 from closing during operation of the electric submersible pump 210.

Figure 9:
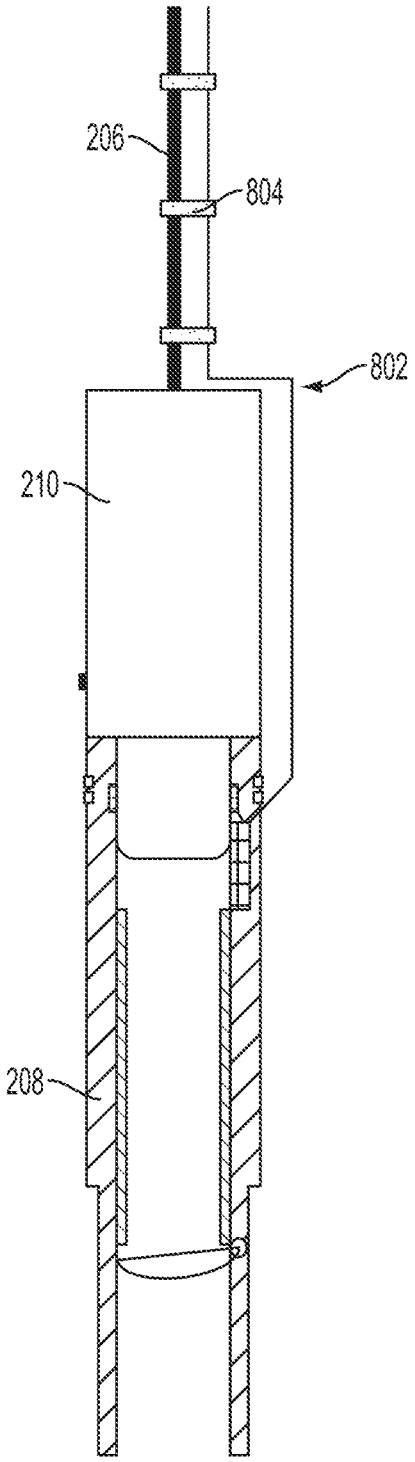
FIG. 9 is a cross-sectional side view of a subsurface safety valve coupled to an electric submersible pump and controlled by a control line according to one embodiment of the present invention.

In additional or alternative embodiments, a control line can be deployed within a passageway defined by the tubing string 112 to control the subsurface safety valve 208. FIG. 9 depicts a cross-sectional side view of a subsurface safety valve 208 coupled to an electric submersible pump 210 and controlled by a control line 802 according to one embodiment. A clamping device 804 can clamp the control line 802 to a cable 206 coupled to the electric submersible pump 210, as depicted in FIG. 9. The control line 802 can be a hydraulic line. The control line 802 can remain pressurized during operation of the subsurface safety valve. A leak or other failure causing a loss of pressure in the control line can cause the subsurface safety valve 208 to close.

In additional or alternative embodiments, the dual closure system 114 can include an equalizing subsystem configured to equalize pressure across the passive closure mechanism 202. A pressure differential across the passive closure mechanism 202 can increase the force required to open the passive closure mechanism 202 as compared to the force required to open the passive closure mechanism 202 when pressure across the passive closure mechanism 202 is equal. Equalizing the pressure across the passive closure mechanism 202 can decrease the force that the subsurface safety valve 208 applies to the passive closure mechanism 202 when opening the passive closure mechanism 202. The equalizing subsystem can include, but is not limited to, an unloading pump equalizing pressure across the passive closure mechanism 202. An unloading pump can equalize pressure across the passive closure mechanism 202 by pumping fluid from a portion of the passageway that is further from the surface of the wellbore 102 to a second portion of the passageway that is closer to the surface of the wellbore 102.

In additional or alternative embodiments, the dual closure system 114 can include an equalizing subsystem configured to equalize pressure across the subsurface safety valve 208. The equalizing subsystem can include, but is not limited to, an unloading pump. An unloading pump can equalize pressure across the active closure mechanism 204 of the subsurface safety valve 208 by pumping fluid from a portion of the passageway that is further from the surface of the wellbore 102 to a second portion of the passageway that is closer to the surface of the wellbore 102.

In additional or alternative embodiments, dual closure system 114 can include one or more features preventing accidental closure during the operation of the electric submersible pump 210. The subsurface safety valve 208 can include a two-stage closing process. The first stage can include transmitting a signal to the subsurface safety valve 208 to close the subsurface safety valve 208 partially. The second stage can include completely closing the subsurface safety valve 208 when the electric submersible pump 210 ceases operation.

In additional or alternative embodiments, the dual closure system 114 can include one or more sensors to monitor performance of the electric submersible pump 210 and/or the subsurface safety valve 208. Monitoring the performance of the electric submersible pump 210 can include monitoring the flow of production fluids. Monitoring the performance of the subsurface safety valve 208 can include monitoring the pressure exerted by formation fluids against the subsurface safety valve 208.

In additional or alternative embodiments, the active closure mechanism can include a first motor for operating the electric submersible pump 210 and a second motor for opening the subsurface safety valve 208. The electric submersible pump 210 can be operated by the first motor if the second motor for opening the subsurface safety valve 208 fails, and vice versa. In other embodiments, the subsurface safety valve 208 can be opened by the same motor operating the electric submersible pump 210. The subsurface safety valve 208 can include gearing and/or clutch mechanisms powered by the motor operating the electric submersible pump 210.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

The invention claimed is:

1. A dual closure system configured for being disposed in a wellbore through a fluid-producing formation, the dual closure system comprising:

a subsurface safety valve comprising a body having an active closure mechanism configured to be positioned in a passageway defined by a tubing string, the subsurface safety valve being coupleable to a control line; and a passive closure mechanism coupleable to the tubing string such that the passive closure mechanism is physically separated from the control line by the body of the subsurface safety valve, wherein the passive closure mechanism is configured to be in a closed position that prevents a flow of fluid to a portion of the passageway that is closer to a surface of the wellbore than the passive closure mechanism in the absence of the subsurface safety valve in the tubing string, and wherein the subsurface safety valve is configured to be positioned in the passageway of the tubing string such that the subsurface safety valve causes the passive closure mechanism to be in an open position that allows the flow of fluid to a second portion of the passageway that is closer to the surface of the wellbore than the passive closure mechanism.

2. The dual closure system of claim 1, wherein the passive closure mechanism comprises one of a flapper valve, a ball valve, or a poppet valve.

3. The dual closure system of claim 1, wherein the active closure mechanism comprises a valve configured to be set in the open position by a force provided via the subsurface safety valve.

4. The dual closure system of claim 3, wherein the valve further comprises at least one of a flapper valve, a ball valve, or a poppet valve.

5. The dual closure system of claim 4, wherein the subsurface safety valve comprises an electric motor configured to provide the force setting the active closure mechanism in the open position.

6. The dual closure system of claim 5, further comprising an electric submersible pump, wherein the electric motor is configured to receive power from the electric submersible pump.

7. The dual closure system of claim 1, further comprising an electric submersible pump coupled to the subsurface safety valve, wherein the electric submersible pump is configured to receive additional power via a power cable.

8. The dual closure system of claim 7, further comprising:

a trigger mechanism configured to terminate operation of the electric submersible pump upon closure of the subsurface safety valve; and a sensor configured to prevent activation of the trigger mechanism during operation of the electric submersible pump.

9. The dual closure system of claim 1, wherein the control line is coupled to an electric submersible pump.

10. The dual closure system of claim 1, further comprising a spring-loaded sleeve, wherein the subsurface safety valve is configured to be positioned in the passageway so as to cause the spring-loaded sleeve to apply a force setting the passive closure mechanism to the open position.

11. The dual closure system of claim 10, wherein the spring-loaded sleeve comprises a spring having tension sufficient to retract the spring-loaded sleeve in the absence of the subsurface safety valve.

12. The dual closure system of claim 1, further comprising an override, the override configured to maintain the subsurface safety valve in the open position during a power failure.

13. The dual closure system of claim 1, further comprising a locking mechanism configured to lock the subsurface safety valve in the open position.

14. The dual closure system of claim 1, wherein the passive closure mechanism is directly coupled to the tubing string, wherein the tubing string extends from the fluid-producing formation to the surface of the wellbore.

15. A method for disposing a dual closure system in a wellbore, comprising:

coupling a passive closure mechanism directly to a tubing string;

positioning the tubing string in the wellbore to allow the passive closure mechanism to prevent a flow of fluid from a fluid-producing formation in the wellbore to a portion of a passageway defined by the tubing string that is closer to a surface of the wellbore than the passive closure mechanism in the absence of a subsurface safety valve in the tubing string; and positioning the subsurface safety valve comprising a body having an active closure mechanism in the passageway such that the subsurface safety valve is coupled to a control line, the body of the subsurface safety valve physically separates the passive closure mechanism from the control line, and to cause the passive closure mechanism to be in an open position that allows the flow of fluid to a second portion of the passageway that is closer to the surface of the wellbore than the passive closure mechanism.

16. The method of claim 15, wherein the tubing string extends from the fluid-producing formation to the surface of the wellbore.

17. The method of claim 15, further comprising:

coupling a spring-loaded sleeve to the passive closure mechanism to set the passive closure mechanism in a closed position in the absence of any subsurface safety valve in the tubing string, wherein positioning the subsurface safety valve in the passageway includes causing the spring-loaded sleeve to apply a force for setting the passive closure mechanism in the open position.

18. The method of claim 15, further comprising:

coupling subsurface safety valve to an electric submersible pump; and coupling the electric submersible pump to a power cable for receiving additional power.

19. The method of claim 15, further comprising:

coupling the subsurface safety valve to an electric submersible pump; and coupling a trigger mechanism to the electric submersible pump to terminate operation of the electric submersible pump upon closure of the subsurface safety valve.

20. The method of claim 15, further comprising:

coupling an override to the subsurface safety valve to maintain the subsurface safety valve in the open position during a power failure.

* * * * *